United States Patent [19]

Miller et al.

[11] 4,138,178

[45] Feb. 6, 1979

[54] DIVER'S COMPOSITE UMBILICAL

[75] Inventors: Barry E. Miller; D. Wayne McClain; William W. McCrory, Jr., all of Panama City, Fla.

[73] Assignee: The United States of America as represented by the Secretary of the Navy, Washington, D.C.

[21] Appl. No.: 852,120

[22] Filed: Nov. 16, 1977

[51] Int. Cl.[2] ..... H01R 3/04

[52] U.S. Cl. ..... 339/15; 29/450; 128/142.3; 174/47; 339/16 R

[58] Field of Search ..... 339/15, 16 R; 174/47; 29/450; 128/142.3

[56] References Cited

U.S. PATENT DOCUMENTS

| | | | |
|---|---|---|---|
| 989,532 | 4/1911 | Macduffee | 174/47 |
| 1,096,607 | 5/1914 | Deray | 128/142.3 |
| 3,649,949 | 3/1972 | McCarthy et al. | 339/16 R |

*Primary Examiner*—Howard N. Goldberg
*Assistant Examiner*—DeWalden W. Jones
*Attorney, Agent, or Firm*—Richard S. Sciascia; Harvey A. David

[57] ABSTRACT

A composite diver's umbilical including concentric hoses for breathing gas, heating fluid supply and return, electrical conductors, and a strength member, and cooperating separable connectors for effecting end to end joining of segments of the umbilical. The connectors are characterized by cooperating nipple and receptacle members having coaxial, arcuate passageways, and cooperating pin and socket electrical connectors.

7 Claims, 5 Drawing Figures

DIVER'S COMPOSITE UMBILICAL

BACKGROUND OF THE INVENTION

This invention relates to diving apparatus and more particularly to an improved diver's life support and safety line, or umbilical.

Modern surface or sub-surface station supported deep sea divers are provided not only with breathing gas but also with heating fluids, communication lines, physical data transmission and other electrical power supply lines. Although some efforts have been made in the past to provide composite supply lines including breathing gas hoses, electrical communication wires, and strength members, so far as is known by the inventors herein, there has not been devised a composite supply line or umbilical providing all of the necessary support functions, and having reliable connector means for joining lengths thereof or making connection between a length and a diver's whip portion normally left attached to the helmet.

DISCUSSION OF THE PRIOR ART

The most commonly used expedient for providing a plurality of support services to a diver is to utilize a plurality of hoses and cables that are made up into a bundle and secured by stops at intervals along the bundle length. Each of the hoses and cables is provided with its own connector. The resulting umbilicals have been unduly heavy, unwieldy, prone to hang up or get caught on objects, and have presented large surface areas to the forces of water currents, all to the detriment of the diver's safety and mobility. Moreover, the numerous couplings or connectors required have increased the likelihood of failure as well as consuming considerably more time than is desirable in dressing a diver.

Early efforts to provide a composite, diver's umbilical, having plural gas passages and electrical conductors, are found in U.S. Pat. No. 989,532 to C. E. Macduffee and U.S. Pat. No. 1,096,607 to J. F. Deray. In each of these, an air supply hose and a used air return hose are enclosed in parallel relation to insulated electrical wires within a flexible outer covering. The combined hose and electrical conductor constructions disclosed in those patents, while a step in the right direction, remain subject to certain disadvantages. Inasmuch as they are intended for use with armored types of diving suits wherein the suit withstands the water pressure while the diver is at substantially atmospheric pressure, the hoses carry relatively low internal pressures and yet must be able to withstand the water pressure without collapsing. Accordingly, these patented hose and cable structures are provided with armor and must necessarily be stiffer, heavier, and larger in cross section than is desirable for use with diving suits wherein the diver is subjected to the pressure of the surrounding water.

Moreover, these prior art composite hose and electrical cable structures require individual connections for each of the elements of the combination, making it wholly impractical to quickly and reliably join lengths thereof.

Hoses having concentric passages have been proposed heretofore as a way to provide a plurality of fluid passages in a single hose structure. One example of such a hose is disclosed in U.S. Pat. No. 2,325,465 to E. C. Bannister for the purpose of conveying fluids to and from earth boring drills. The hose structure of the Bannister patent also describes coupling means for joining such concentric hoses end-to-end, and a tension cable. No provisions are made, however, for electrical conductors or their connections.

U.S. Pat. No. 3,649,949 to J. W. McCarthy, et al discloses a quick disconnect fluid-electrical coupler for a single passage hose having electrical conductors therein. That coupler is limited to the conveyance of a single fluid and so would be required to be used in a bundle to provide breathing gas, heating fluid, and return thereof.

SUMMARY OF THE INVENTION

With the foregoing in mind, the present invention aims to overcome most or all of the shortcomings and disadvantages of the prior art relating to the connection of a diver to a support station for the supply of breathing gas, heating fluid, electrical power, and safety tethering.

It is, therefore, a principal object of this invention to provide an improved diver's umbilical or composite life support, communication, and safety line for interconnecting a diver with a support station.

Another object of the invention is the provision of a diver's umbilical line or composite hose and electrical conductor structure having a plurality of insulated wires, together with novel coupling means for joining lengths or segments thereof.

Still another object is the provision of a diver's umbilical for providing various fluid and electrical services and comprising a combined fluid passage and electrical coupling that maintains the integrity of plural concentric fluid flow passages and assures electrical connection of predetermined ones of a plurality of electrical conductors in one umbilical segment with corresponding conductors in another segment.

Yet another object of this invention is the provision of a highly flexible, durable and compact composite umbilical supply line of the foregoing character that includes synthetic fiber means for imparting unusual tensile strength to the supply line without the need of a stranded wire lifeline or tension cable.

A further object is the provision of a concentric rubber or rubber-like hose structure including insulated electrical conductors and a fibrous strength material molded in the hose outer wall, and coupling means including a plurality of cooperable pin and socket connector elements having wire attachment portions that are readily accessible for inspection, repair, or change of wire connections.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
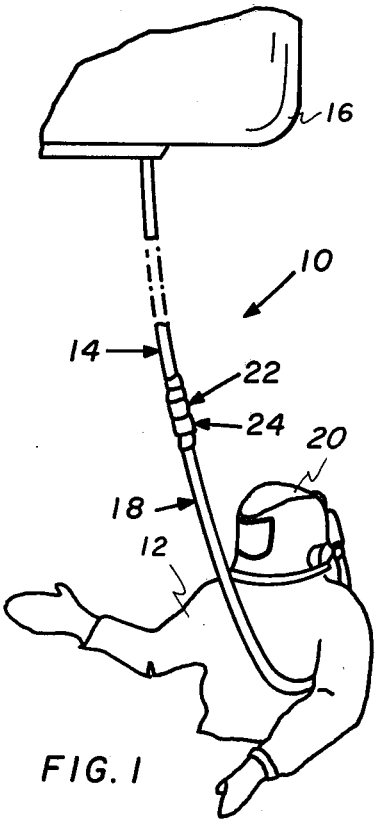
FIG. 1 is a fragmentary elevational view illustrating a diver's umbilical, embodying the invention, interconnecting a diver and a support station.

Referring to FIG. 1, a diver's composite life support and safety line, or umbilical, is generally indicated at 10 and serves to supply a diver 12 with breathing gas, heating water, electrical communication, and a tether of sufficient strength to serve as a life line. The umbilical 10 comprises a topside segment 14 extending from a support station 16, and a diver's whip segment 18 connected to the helmet 20 of the diver. The segments 14 and 18 are provided with mating connectors 22 and 24, respectively, by which the umbilical segments are readily joined or separated.

Figure 2:
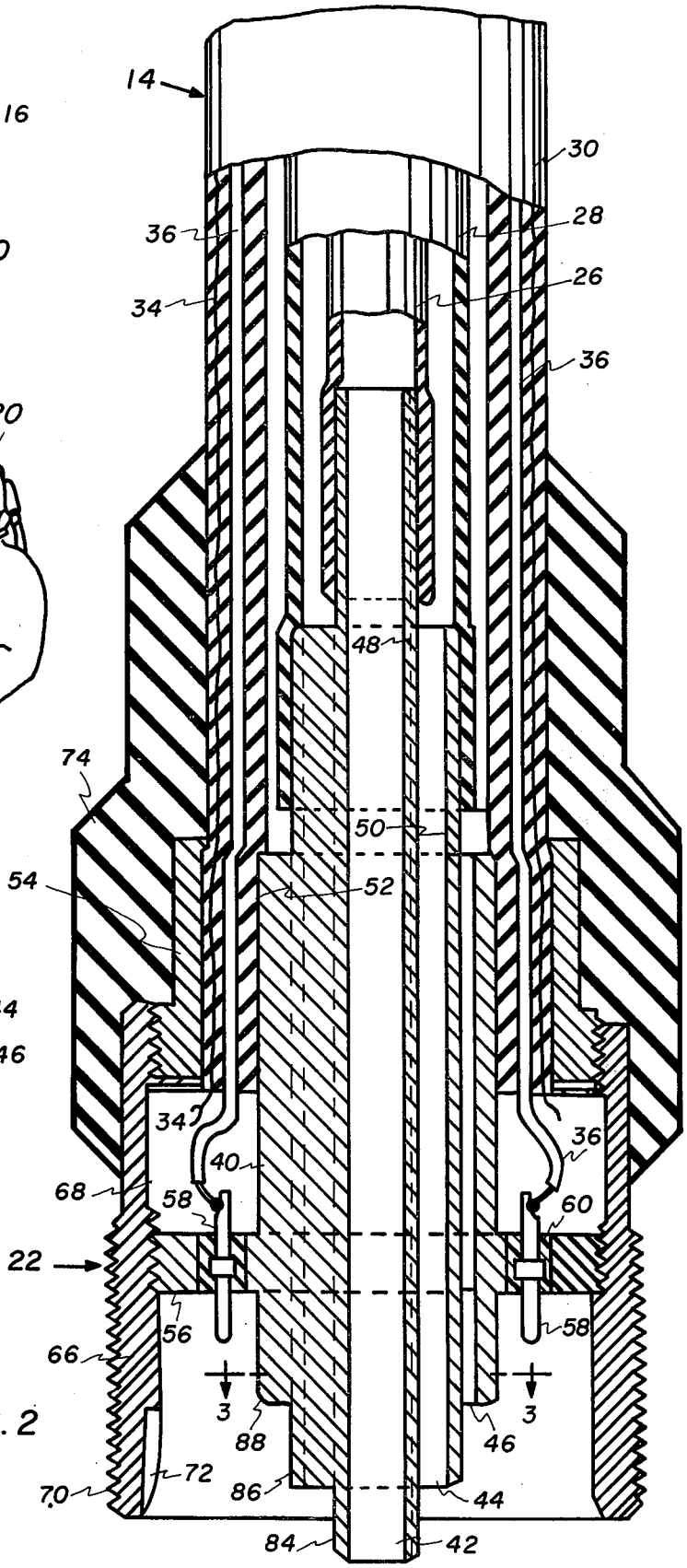
FIG. 2 is an enlarged view, partly in section, of one end of a segment of the umbilical of FIG. 1.

Referring now to FIG. 2, the distal end of the topside umbilical segment 14 comprises a plurality of concentric flexible hoses 26, 28, and 30. Hose 26 serves as a breathing gas supply line, hose 28 as a hot water supply line, and hose 30 as a water return line. These flexible hoses are formed of rubber or rubber-like plastic material and may be reenforced as by the inclusion of cords, fabric, or the like, (not shown), in a manner well known in the hose art to minimize stretch or balooning. In addition, preferably embedded in the wall of the outermost hose 30 is a strength member 34 comprising filaments, strands, or a tubular meshwork, formed of a highly stretch resisting material such as the synthetic fiber sold under the trademark "KEVLAR." This strength member 34 provides the umbilical 10 with its safety or life-line capability, replacing the separate life-line usually bundled with the diver's air hose.

Also embedded in the wall of the outermost hose 30 are a plurality of suitably insulated, and electrically shielded if necessary, electrical conductors 36. These conductors provide electrical service for communications, physiological data transmissions, and the like, and are provided with means incorporated in the connector 22, about to be described.

Figure 3:
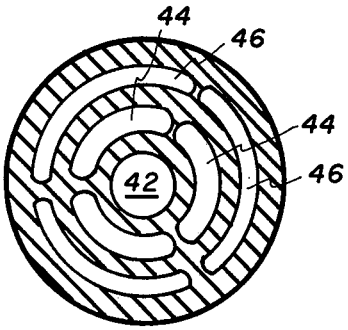
FIG. 3 is a fragmentary sectional view taken substantially along line 3—3 of FIG. 2.

The connector 22 comprises an inner nipple member 40 in which are defined a central passage 42, intermediate arcuate passages 44, and outer arcuate passages 46, best illustrated in FIG. 3. The concentric hoses 26, 28, and 30 are fitted to stepped portions 48, 50, and 52 of the nipple member 40 so as to communicate with the passages 42, 44, and 46, respectively. A metal collar 54 surrounds the portion of the outer hose 30 that is on the nipple portion 52, and is preferably swaged so as to tightly clamp that hose to the nipple member. In addition, cements and vulcanization by autoclave or microwave processing may be used to advantage in bonding the hoses to their nipple portions.

A circular radial flange 56 extends from the nipple member 40 and carries a plurality of electrical connector pins 58, arranged in a circular array and fixed in openings in the flange by suitable insulating material 60 such as a rigid, waterproof epoxy. The ends of the conductors 36 extend beyond the hose 30 and are soldered or otherwise attached to the inner ends of the pins 58.

The periphery of the flange 56 and the outer end portion of the collar 54 are externally threaded, as shown. A generally cylindrical connector member 66 has internal threads cooperating with the external threads of the collar 54 and the flange 56, and serves to define an annular chamber 68 in which the connections between the conductors 36 and the inner ends of the pins 58 are housed. It will be noted that the described construction permits the wire to pin connections to be made before assembly of the connector member 66 as part of connector 22, and that the member 66 may later be removed to expose those connections for inspection or repair. A potting compound may, if desired, be used in the chamber 68.

The exterior of the connector member 66 is provided with threads 70 and a keyway 72 for cooperation with the connector 24, about to be described. A rubber sleeve 74 is molded about the junction of the hose portion 14 and the connector 22 to aid in strength transfer, water exclusion, and to serve as a protective bumper.

Figure 4:
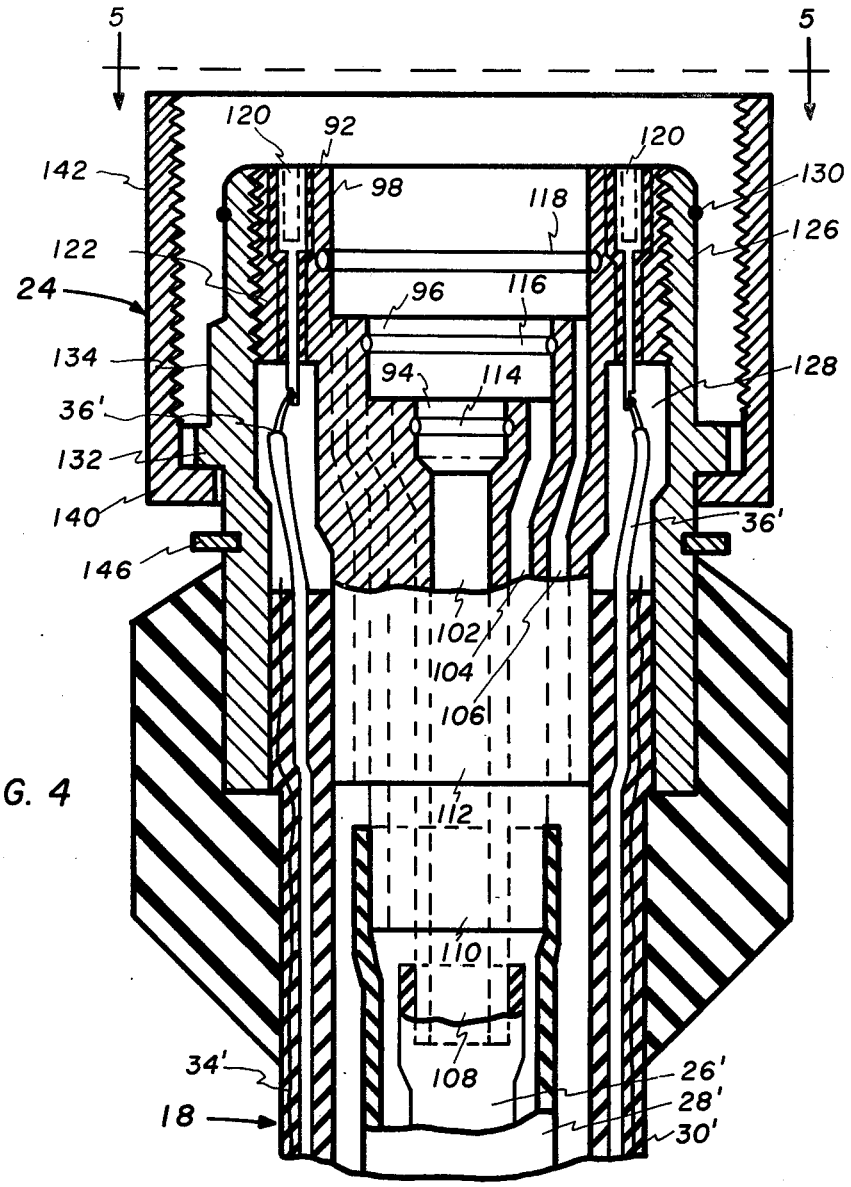
FIG. 4 is an enlarged view, partly in section of an end of another segment of the umbilical of FIG. 1.
Figure 5:
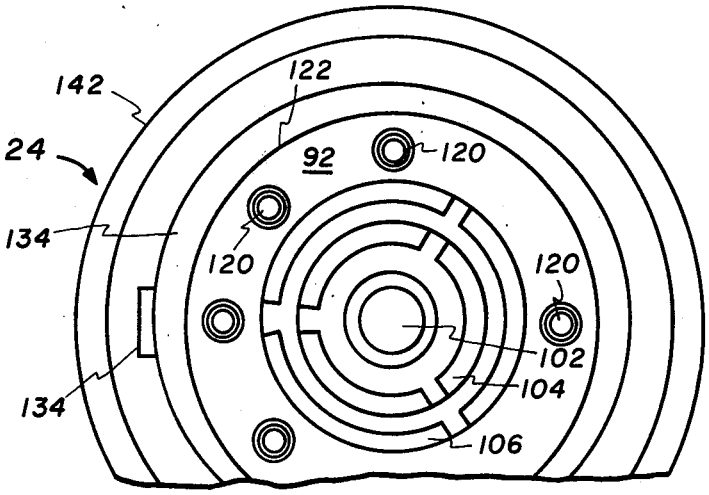
FIG. 5 is an elevational view of the end portion of FIG. 3 as seen from along line 5—5 thereof.

The nipple member 40 of the connector 22 presents stepped, coaxial nipple portions 84, 86, and 88 extending beyond the flange 56 and adapted to be received by the connector 24 of the diver's whip segment 18 of the umbilical 10. Referring to FIGS. 4 and 5, the connector 24 comprises a central receptacle member 92 having stepped, coaxial bores 94, 96, and 98 that are sized to nicely receive the nipple portions 84, 86, and 88, respectively. The stepped bores 94, 96, and 98 communicate via passages 102, 104, and 106 with the passages of concentric hoses 26', 28', and 30' of the whip portion through coaxial nipple portions 108, 110, and 112, respectively, of the receptacle member 92.

The stepped, coaxial bores 94, 96, and 98 are provided with annular recesses in which are disposed O-rings 114, 116, and 118 for effecting sealing relationships with the nipple portions 84, 86, and 88 when received in the receptacle member 92. A circular array of electrical connector pin sockets 120 are recessed into an externally threaded flange portion 122 of the receptacle member 92, the sockets being electrically insulated from the member 92 and having inwardly extending portions connected to wires 36', corresponding to wires 36 of the hose segment 14.

A generally cylindrical metal collar 126 surrounds the portion of the hose 30' that is on the nipple portion 112, and serves to clamp that hose thereto. The hose 30', like hose 30, comprises a strength member 34' that provides life line capability to the diver's whip segment 18. The collar 126 is internally threaded near its outer end and is threadedly engaged with the flange 122 of the nipple member 92. The member 92 and the collar 126 define an annular space 128 in which the wire to socket connections are disposed.

The collar 126 is further provided with an O-ring 130, an annular external flange 132, and an axially extending key 134. The O-ring 130 is adapted to sealingly engage with the inner surface of the member 66 of the connector 22, while the key 134 is adapted to cooperate with the keyway 72 of member 66 to provide alignment of the pins 58 with the sockets 120 during assembly of the connectors 22 and 24.

The flange 132 cooperates with an inwardly directed flange 140 of an internally threaded coupling member 142 that is rotatable on the collar 126 and adapted to cooperate with the externally threaded member 66 in joining the couplings 22 and 24. A retaining ring 146 limits movement of the coupling member 142 rearwardly along the collar 126 and serves as a thrust bearing during separation of the connectors 22, 24.

A rubber sleeve 148 is molded about the junction of the hose portion 18 and the connector 24 to aid in strength transfer, water exclusion, and to serve as a protective bumper.

From the foregoing description, it will be appreciated that the invention provides a diver's umbilical or composite hose, life line, and communication construction, including connector means for separably joining lengths or segments thereof, that satisfies the previously stated objects and advantages.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A composite diver's umbilical for providing a diver with both fluid and electrical services, said umbilical comprising:

at least first and second umbilical segments each having fluid and electrical service means;

first and second connector means for releasably connecting said first and second segments together in end-to-end relation;

said connector means being cooperative to simultaneously effect coupling of the fluid and electrical service means of one of said segments to the fluid and electrical service means, respectively, of the other of said segments;

said segments each comprising a plurality of flexible hoses, including at least an outermost hose and an innermost hose, arranged substantially coaxially and defining a plurality of fluid passages as said fluid service means, said hoses comprising walls formed of a flexible, electrically insulative material;

said electrical service means comprising electrical conductor means embedded in the wall of at least one of said hoses;

said first connector means comprising a rigid nipple member having a central passageway and a plurality of arcuate passageways arranged concentrically about said central passageway, said nipple member presenting at one end thereof a plurality of cylindrical nipple portions of stepped diameters, said nipple member presenting at its other end a second plurality of cylindrical portions of stepped diameters on which hoses of one of said segments are engaged with their lumens in communication with respective ones of said passageways of said nipple member, and a first flange extending radially from said nipple member between the ends thereof;

said second connector means comprising a rigid receptacle member having a central passageway and a plurality of arcuate passageways arranged concentrically about said central passageway, said receptacle member defining at one end thereof a plurality of cylindrical bores of stepped diameters and operative as a receptacle to receive said nipple portions of said nipple portions of said nipple member of said first connector means, said receptacle member presenting at its other end a plurality of cylindrical portions of stepped diameters on which hoses of one of said segments are engaged with their respective lumens in communication with respective ones of said passageways of said receptacle member, and a second flange extending radially from said receptacle member substantially at said one end thereof;

cooperable first and second electrical connector elements mounted on said first and second flanges, respectively, and connected to the electrical conductors of the respective hoses;

collar means for clamping at least the outermost hose to each of said nipple and receptacle members; and coupling means for releasably securing said nipple and receptacle members together with said nipple portions received in said receptacle bores, and with said first and second electrical elements in cooperative engagement.

2. A composite diver's umbilical as defined in claim 1, and wherein:

said collar means comprises cylindrical sleeve members threadedly engaged on said first and second flanges and cooperating with said nipple and receptacle members to define cavities for electrical connections between said electrical conductor means and said electrical connector elements.

3. A composite diver's umbilical as defined in claim 2, and wherein said coupling means comprises an internally threaded cylindrical coupling member rotatably mounting on one of said collar means and adapted to threadedly engage another of said collar means.

4. A composite diver's umbilical as defined in claim 2, and further comprising strength means, embedded in said wall of said outermost hose, for providing longitudinal strength to said umbilical.

5. A composite diver's umbilical as defined in claim 2, and wherein:

said first and second electrical connector elements comprise a plurality of connector pins mounted in a predetermined pattern on one of said flanges, and a corresponding plurality of connector pin sockets mounted in a complimentary pattern on the other of said flanges; and said first and second connector means comprise means for aligning said pins and pin sockets during assembling of said first and second connecting means with one another.

6. A composite diver's umbilical as defined in claim 3, and further comprising strength means, embedded in said wall of said outermost hose, for providing longitudinal strength to said umbilical.

7. A composite diver's umbilical as defined in claim 6, and wherein:

said first and second electrical connector elements comprise a plurality of connector pins mounted in a predetermined pattern on one of said flanges, and a corresponding plurality of connector pin sockets mounted in a complimentary pattern on the other of said flanges; and said first and second connector means comprise means for aligning said pins and pin sockets during assembling of said first and second connecting means with one another.

* * * * *